US011085654B2

(12) United States Patent
Goto et al.

(10) Patent No.: US 11,085,654 B2
(45) Date of Patent: Aug. 10, 2021

(54) OUTDOOR UNIT FOR AIR CONDITIONER

(71) Applicant: Samsung Electronics Co., Ltd., Suwon-si (KR)

(72) Inventors: Shinji Goto, Yokohama (JP); Hiroaki Kurihara, Yokohama (JP); Suguru Nakagawa, Yokohama (JP)

(73) Assignee: Samsung Electronics Co., Ltd., Suwon-si (KR)

( * ) Notice: Subject to any disclaimer, the term of this patent is extended or adjusted under 35 U.S.C. 154(b) by 75 days.

(21) Appl. No.: 16/461,301

(22) PCT Filed: Nov. 14, 2017

(86) PCT No.: PCT/KR2017/012871
§ 371 (c)(1),
(2) Date: May 15, 2019

(87) PCT Pub. No.: WO2018/093115
PCT Pub. Date: May 24, 2018

(65) Prior Publication Data

US 2019/0316790 A1 Oct. 17, 2019

(30) Foreign Application Priority Data

Nov. 15, 2016 (JP) ..... JP2016-222199
Nov. 2, 2017 (JP) ..... JP2017-213284

(51) Int. Cl.
*F24F 1/38* (2011.01)

(52) U.S. Cl.
CPC ..... *F24F 1/38* (2013.01)

(58) Field of Classification Search
CPC ..... F24F 1/38; F24F 1/56
See application file for complete search history.

(56) References Cited

U.S. PATENT DOCUMENTS

2006/0045777 A1 3/2006 Kao et al.
2016/0305452 A1* 10/2016 Nakagawa ..... F04D 29/325
2018/0224135 A1* 8/2018 Yamamoto ..... F24F 1/38

FOREIGN PATENT DOCUMENTS

JP 2013-096622 A 5/2013
JP 2013-221439 A 10/2013
JP 2015/129504 * 7/2015 ..... F25B 39/00
KR 10-2003-0035328 A 5/2003
KR 10-2009-0076031 A 7/2009

OTHER PUBLICATIONS

ISA/KR, "International Search Report and Written Opinion of the International Searching Authority," International Application No. PCT/KR2017/012871, dated Jan. 31, 2018, 13 pages.

* cited by examiner

*Primary Examiner* — Cassey D Bauer

(57) ABSTRACT

Disclosed herein is an outdoor unit for an air conditioner including a blowing apparatus for reducing suction loss of a propeller fan generated in corners of a housing and achieving high efficiency of blowing and low noise. The blowing apparatus includes a housing including a wall in which an outlet is formed, a propeller fan positioned in the inside of the housing, the propeller fan facing the outlet, and a diffuser positioned at a discharging side of the propeller fan, and forming the outlet, wherein the diffuser includes an inclined surface inclined with respect to a rotation axis of the propeller fan, and an inclination angle of the inclined surface to the rotation axis of the propeller fan changes according to a circumferential direction of the diffuser.

16 Claims, 12 Drawing Sheets

CROSS-SECTIONAL VIEW TAKEN ALONG LINE A-A′

CROSS-SECTIONAL VIEW TAKEN ALONG LINE B-B′

CROSS-SECTIONAL VIEW TAKEN ALONG LINE C-C′

CROSS-SECTIONAL VIEW TAKEN ALONG LINE D-D'

CROSS-SECTIONAL VIEW TAKEN ALONG LINE E-E'

OUTDOOR UNIT FOR AIR CONDITIONER

CROSS-REFERENCE TO RELATED APPLICATIONS

This application is a 371 National Stage of International Application No. PCT/KR2017/012871, filed Nov. 14, 2017, which claims priority to Japanese Patent Application No. 2016-222199, filed Nov. 15, 2016 and Japanese Patent Application No. 2017-213284, filed Nov. 2, 2017, the disclosures of which are herein incorporated by reference in their entirety.

BACKGROUND

1. Field

The present disclosure relates to a blowing apparatus and an outdoor unit for an air conditioner using the blowing apparatus.

2. Description of Related Art

As a typical outdoor unit for an air conditioner, there is a side blowing outdoor unit, as shown in FIGS. 10 and 11.

In the side blowing outdoor unit, a propeller fan faces an outlet formed in the front wall of the housing, and a diffuser is installed at a discharging side of the propeller fan. Also, in the inside of the housing, a heat exchanger is installed along the rear and left or right walls of the housing.

The side blowing outdoor unit has difficulties in securing a sufficient space for installing the diffuser due to its structure, and the length dimension in inclination angle or blowing direction of the inclined surface of the diffuser is limited. Generally, the diffuser has high efficiency at a great length dimension in blowing direction, and in many cases, an optimal value appears at a great inclination angle (opening angle) to the propeller fan.

However, there are many cases in which an inlet cannot be installed along the entire circumference of the outdoor unit due to the arrangement of various components. Therefore, fluid resistance in the corners of the housing becomes great compared to that of the other part, resulting in suction loss of the propeller fan. Also, because great pressure loss is generated by a fan guide installed downstream, it may be difficult to achieve the high efficiency and low noise of the outdoor unit.

In Patent Document 1, in the opening (corresponding to a diffuser) of a bell mouth installed downstream from a propeller fan, the radius of curvature of a part closer to a partition wall of a machine room and a blower room and the radius of curvature of a part closer to an outdoor heat exchanger are smaller than the radius of curvature of a part that is more distant from the partition wall and the outdoor heat exchanger. The Patent Document 1 is aimed at obtaining an effect of preventing flow deterioration of air at the part close to the partition plate or the outdoor heat exchanger in the opening of the bell mouth, by studying the shape of the opening of the bell mouth.

However, the configuration could not reduce suction loss generated by fluid resistance in the corners of the housing where the inlet is not located, and accordingly, it still has difficulties in achieving the high efficiency of blowing and low noise.

PRIOR ART

Patent Document

[Patent Document 1] Japanese Laid-open Patent Application No. 2013-96622

SUMMARY

The present disclosure is directed to reducing suction loss of a propeller fan, which is generated by a positional relationship between an inlet of a housing and the propeller fan, and to achieving the high efficiency of blowing and low noise.

One aspect of the present disclosure provides an outdoor unit for an air conditioner including a blowing apparatus, the blowing apparatus including: a housing including a wall in which an outlet is formed; a propeller fan positioned in the inside of the housing, the propeller fan facing the outlet; and a diffuser positioned at a discharging side of the propeller fan, and forming the outlet, wherein the diffuser includes an inclined surface inclined with respect to a rotation axis of the propeller fan, and an inclination angle of the inclined surface to the rotation axis of the propeller fan changes according to a circumferential direction of the diffuser.

The wall may be in the shape of a polygon with a plurality of corners, and a maximum value of the inclination angle may appear in an area that is adjacent to at least one corner among the plurality of corners of the wall.

The wall may be a front wall forming a front surface of the housing.

The housing may include a rear wall, a left wall, and a right wall, the left wall and the right wall being located in both sides of the rear wall, and the housing may include an inlet formed in at least one of the rear wall, the left wall, and the right wall.

The outdoor unit may further include a heat exchanger formed along the inlet to correspond to the inlet.

The housing may include a front panel forming the front wall, and the diffuser may be integrated into the front panel.

The inclined surface may include a maximum inclination portion with a maximum inclination angle.

The maximum inclination portion may be formed in one end of the inclined surface.

The front wall may be in the shape of a polygon with a plurality of corners, and at least two maximum inclination portions may be positioned to correspond to neighboring corners among the plurality of corners.

The front wall may be in the shape of a polygon with a plurality of corners, and at least two maximum inclination portions may be positioned to correspond to the most distant corners among the plurality of corners.

The inclined surface may include a maximum inclination portion with a maximum inclination angle, and the maximum inclination portion may be positioned to correspond to a corner that is most adjacent to at least one of the left wall and the right wall.

Another aspect of the present disclosure provides an outdoor unit for an air conditioner including a blowing apparatus, the blowing apparatus including: a housing in which an inlet and an outlet are formed; a propeller fan positioned in the inside of the housing, and configured to discharge air inhaled through the inlet through the outlet; and a diffuser positioned at a discharging side of the propeller fan, and including an opening, wherein a radius of an end of the opening of the diffuser in a radial direction of the propeller fan changes according to a circumferential direction of the diffuser.

The end of the opening of the diffuser may include a maximum inclination portion in which the radius of the end of the opening of the diffuser is a maximum value.

The maximum inclination portion may be positioned in a first area corresponding to an area in which the inlet does not exist in the housing.

The maximum inclination portion may be positioned in a second area that is opposite to the first area.

The end of the opening of the diffuser may include a minimum inclination portion with a minimum radius, and a distance from the maximum inclination portion of the first area to the minimum inclination portion may be different from a distance from the maximum inclination portion of the second area to the minimum inclination portion.

The housing may include a front wall in which the outlet is formed, the front wall is in the shape of a polygon with a plurality of corners, and at least two maximum inclination portions may be positioned to correspond to neighboring corners among the plurality of corners.

The housing may include a front wall in which the outlet is formed, the front wall is in the shape of a polygon with a plurality of corners, and at least two maximum inclination portions may be positioned to correspond to the most distant corners among the plurality of corners.

The housing may include a rear wall in which the outlet is formed, and a left wall and right wall located in both sides of the front wall, and the maximum inclination portion may be positioned to correspond to a corner that is most adjacent to at least one of the left wall and the right wall.

According to the embodiments of the disclosure, because the diffuser has a maximum inclination portion in an area in which the suction loss of the propeller fan is relatively great, it may be possible to reduce the suction loss of the propeller fan generated by a positional relationship between the inlet of the housing and the propeller fan, and to achieve the high efficiency of blowing and low noise.

DETAILED DESCRIPTION

Hereinafter, an outdoor unit for an air conditioner using a blowing apparatus according to an embodiment of the disclosure will be described with reference to the accompanying drawings.

Figure 1:
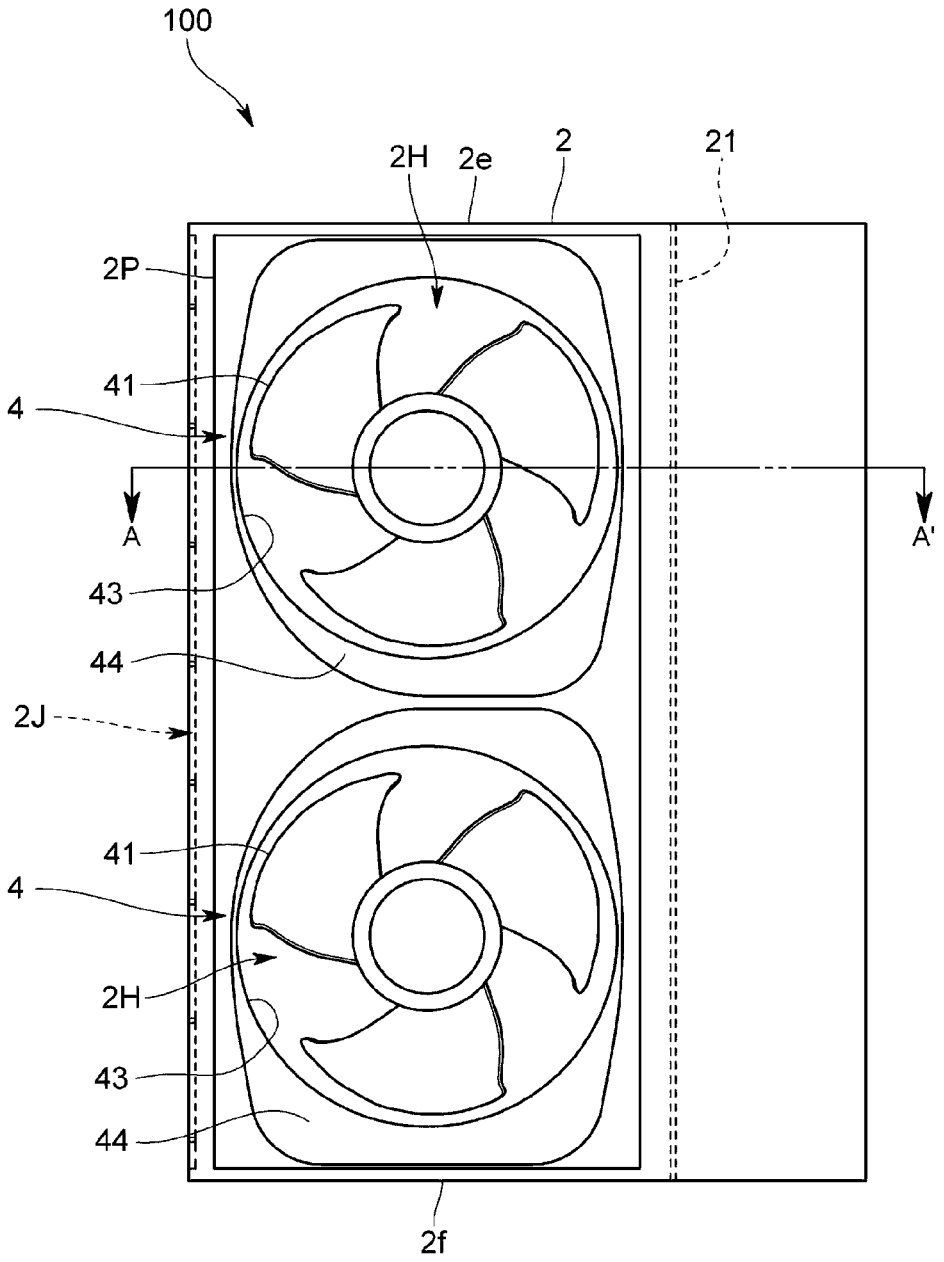
FIG. 1 is a front view of an outdoor unit for an air conditioner according to an embodiment of the disclosure.
Figure 2:
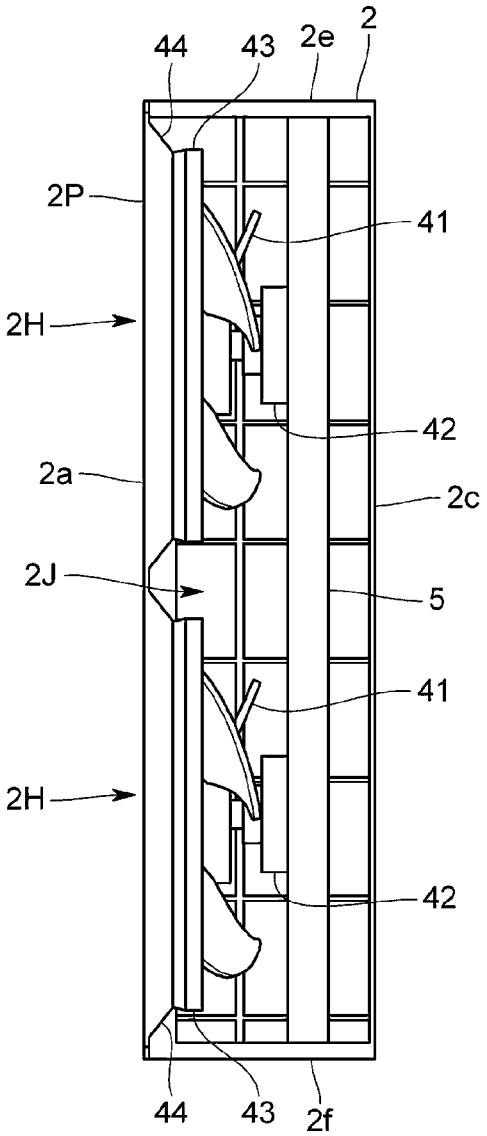
FIG. 2 schematically shows a positional relationship between an outlet and a blower in an outdoor unit for an air conditioner according to an embodiment of the disclosure.
Figure 3:
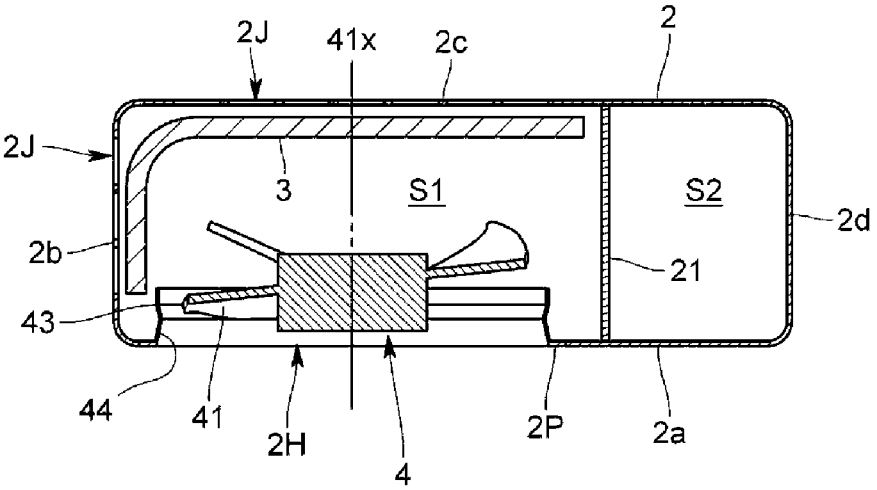
FIG. 3 is a cross-sectional view taken along line A-A' of FIG. 1.

An outdoor unit 100 for an air conditioner according to an embodiment of the disclosure may be a side blowing outdoor unit, and may include, as shown in FIGS. 1 to 3, a housing 2 of a rectangular parallelpiped, an outdoor heat exchanger 3 accommodated in the housing 2, and a blower 4 accommodated in the housing 2 and configured to blow outside air to the outdoor heat exchanger 3.

The housing 2 may be partitioned into two left and right spaces by a partition plate 21, wherein one (left space) S1 of the spaces may be a blowing room where the outdoor heat exchange 3 and the blower 4 are accommodated, and the other one (right space) S2 may be a machine room where components such as a compressor constituting a cooling cycle or other electronic components are accommodated.

Also, a front wall 2*a* of the housing 2 may form a rectangular shape as seen from front, and in upper and lower portions of the front wall 2*a*, two outlets 2H may be formed. Areas in which the outlets 2H are formed in the front wall 2*a* may correspond to areas forming the blowing room S1. A fan guide (not shown) may be positioned along an outer circumference of each outlet 2H.

Also, in a side wall (for example, a left wall 2*b* of FIG. 2) and a rear wall 2*c* of the housing 2, an inlet 2J may be formed to introduce outside air to the inside of the housing 2. Also, an area in which the inlet 2J is formed in the rear wall 2*c* may correspond to the area in which the blowing room S1 is formed.

The outdoor heat exchanger 3 may be positioned in a nearly L shape along the left wall 2*b* and the rear wall 2*c* of the housing 2. Also, the outdoor heat exchanger 3 may be a split structure configured with a heat exchange component positioned along the left wall 2*b* and another heat exchange component positioned along the rear wall 2*c*.

Two blowers 4 may be installed to respectively correspond to the two outlets 2H. By the blowers 4, air may be inhaled through the inlet 2J of the left wall 2*b* and the rear wall 2*c* of the housing 2, and then discharged through the outlets 2H formed in the front wall 2*a* of the housing 2.

More specifically, each blower 4 may include a propeller fan (an axial-flow fan) 41 facing the corresponding outlet 2H, a motor 42 for rotating the propeller fan 41, a bell mouth 43 of a cylindrical shape installed in the outside in radial direction of the propeller fan 41, and a diffuser 44 extending from the bell mouth 43.

The propeller fan 41 and the motor 42 may be fixed in a predetermined area facing the outlet 2H by a motor bracket (a supporter) 5 fixed in the inside of the housing 2 (see FIG. 2).

Figure 4:
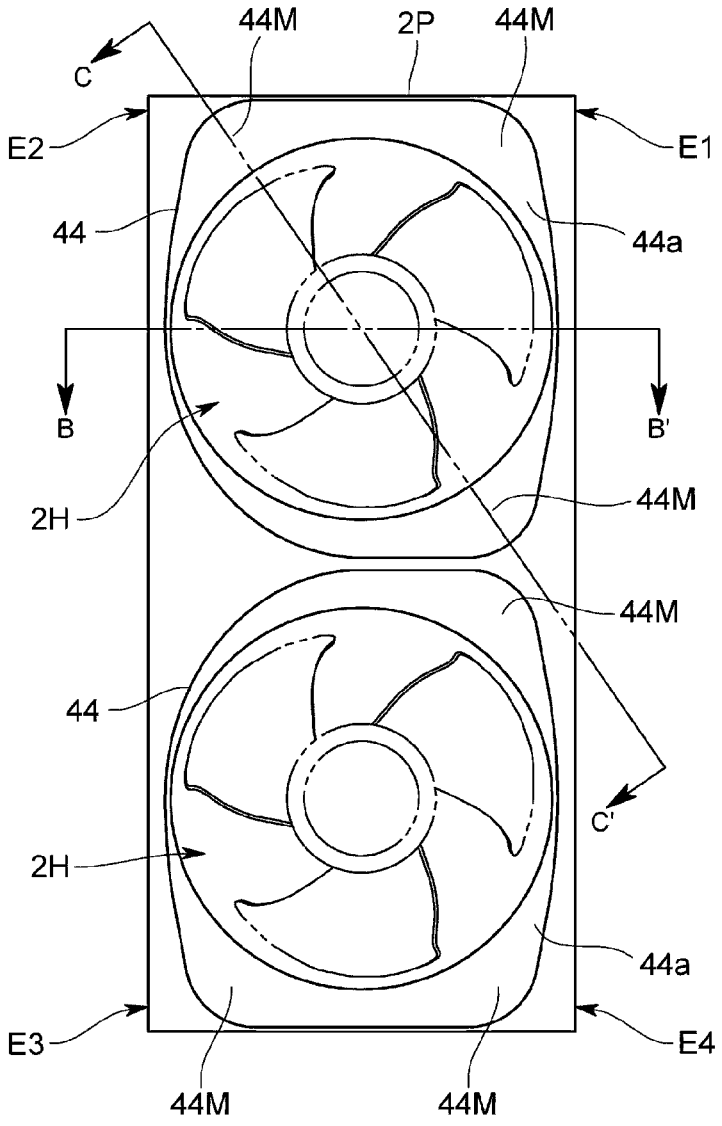
FIG. 4 is a plan view of a front panel of an outdoor unit for an air conditioner according to an embodiment of the disclosure.
Figure 5:
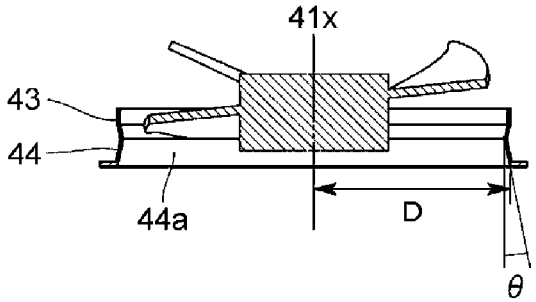
FIG. 5 is cross-sectional views taken along line B-B' and line C-C' of FIG. 4.
Figure 5:
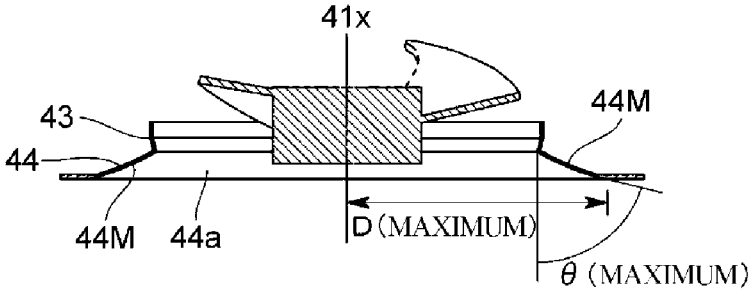

The diffuser 44 may extend from an end of the bell mouth 43 towards the outlet 2H and be integrated into the bell mouth 43, as shown in FIGS. 3 to 5. The diffuser 44 may also be integrated into the front panel 2P forming the front wall 2*a*. That is, the bell mouth 43, the diffuser 44, and the front panel 2P may be integrated into one body, and an opening of the diffuser 44 toward the outlet 2H may be the same configuration as that of the outlet 2H.

The front panel 2P according to an embodiment of the disclosure may form a rectangular shape as seen from front, as shown in FIG. 4, and include the two outlets 2H. In the outdoor unit 100 according to the current embodiment of the disclosure, the outlets 2H may be formed in the upper and lower portions of the front wall 2*a*.

Also, the diffuser 44 according to the current embodiment of the disclosure may include an inclined surface 44*a* inclined outward in the radial direction with respect to a rotation axis 41*x* of the propeller fan 41, as shown in FIGS. 4 and 5. An inclination angle of the inclined surface 44*a* with respect to the rotation axis 41*x* of the propeller fan 41 may change according to a circumferential direction of the diffuser 44.

Also, an opening dimension D of the opening of the diffuser 44 toward the outlet 2H, that is, the radius of an end of the opening of the diffuser 44 toward the outlet 2H may change according to the circumferential direction of the diffuser 44. Herein, the opening dimension D may be a distance between the end of the opening of the diffuser 44 toward the outlet 2H and the rotation axis 41*x* of the propeller fan 41, in the radial direction of the diffuser 44. Also, an opening of the diffuser 44 toward the inlet 2J may be in the shape of a circle, like the bell mouth 43. Therefore, a cross-section of the inclined surface 44*a* may be a straight-line shape or a curved shape.

The diffuser 44 may have maximum inclination portions 44M in first areas in which the inlet 2J does not exist in the outside in radial direction of the rotation axis 41*x* as seen from the axial direction of the rotation axis 41*x*, wherein the maximum inclination portion 44M has a maximum inclination angle θ or a maximum opening dimension D. More specifically, the diffuser 44 may have the maximum inclination portions 44M of the maximum inclination angle θ or the maximum opening dimension D in areas that are adjacent to corners E1 and E4 close to the partition plate 21 among four corners E1 to E4 (also, referred to as first to fourth corners E1 to E4) of the front panel 2P. The maximum inclination portions 44M may be formed in one end of the inclined surface 44*a* of the diffuser 44.

The maximum inclination portions 44M may reduce flow resistance in an area in which suction loss of the propeller fan 41 is relatively great in the circumferential direction, thereby uniformizing suction in the circumferential direction of the propeller fan 41.

Figure 6:
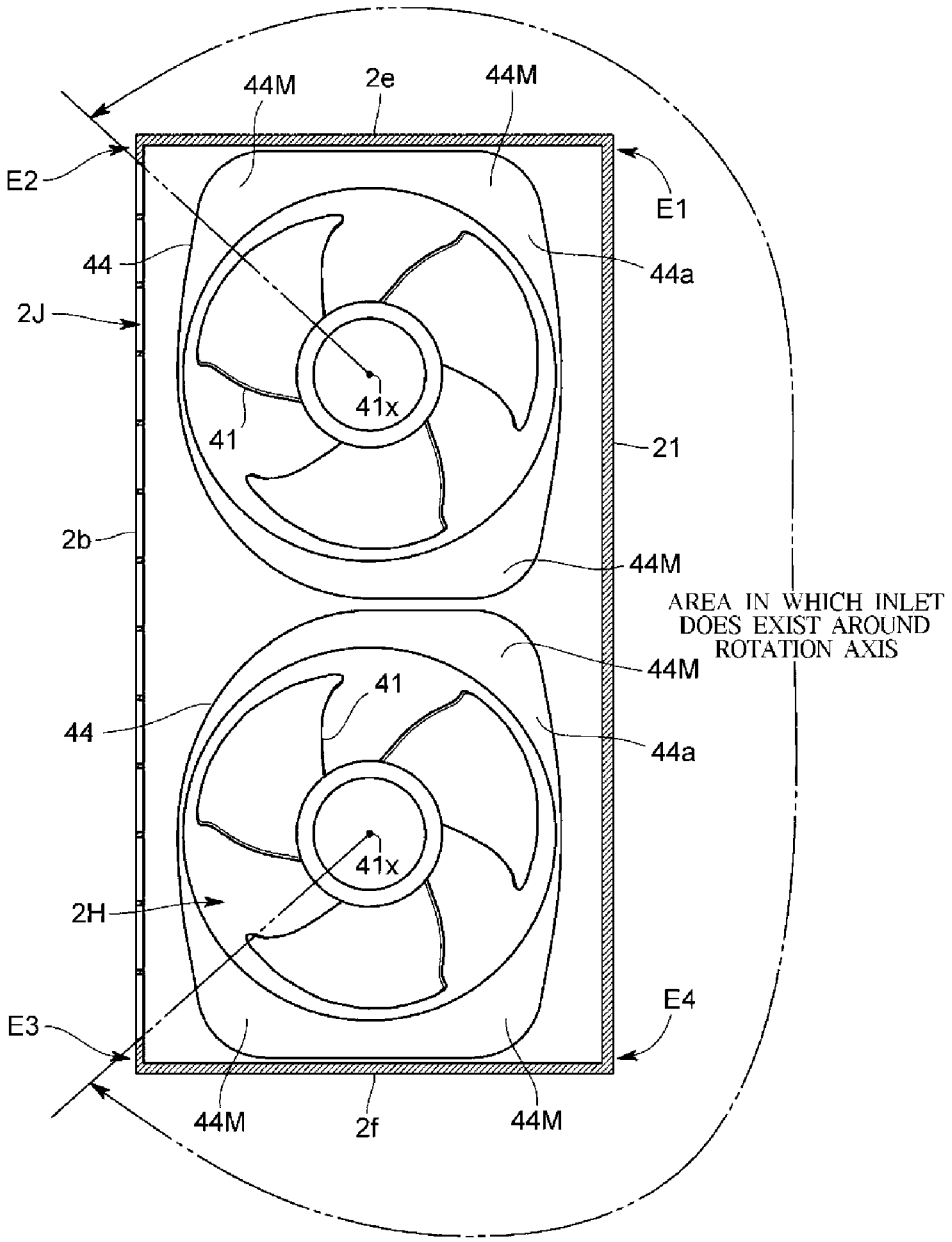
FIG. 6 is a front view showing a positional relationship between maximum inclination portions and corners of an outdoor unit for an air conditioner according to an embodiment of the disclosure.

As shown in FIG. 6, the first corner E1 may be a corner formed by a upper wall 2*e* and the partition plate 21, and in the first corner E1, the inlet 2J may be not located. The second corner E2 may be a corner formed by the upper wall 2*e* and a upper portion (an area where the inlet 2J does not exist) of the left wall 2*b*, and in the second corner E2, the inlet 2J may be not located. The third corner E3 may be a corner formed by a lower wall 2*f* and a lower portion (an area where the inlet 2J does not exist) of the left wall 2*b*, and in the third corner E3, the inlet 2J may be not located. The fourth corner E4 may be a corner formed by the lower wall 2*f* and the partition plate 21, and in the fourth corner E4, the inlet 2J may be not located.

More specifically, the upper diffuser 44 may have the maximum inclination portions 44M, in areas that are adjacent to the three corners E1, E2, and E3 among the four corners E1 to E4. In the upper diffuser 44, the areas that are adjacent to the three corners E1, E2, and E3 may be the first areas in which the inlet 2J does not exist in the outside in radial direction of the rotation axis 41*x* as seen from the axial direction of the rotation axis 41*x*. Also, in the upper diffuser 44, the maximum inclination portion 44M may be not provided in an area (a second area) that is adjacent to the third corner E3 that is opposite to the area (the first area) that is adjacent to the first corner E1.

Also, the lower diffuser 44 may have the maximum inclination portions 44M in areas that are adjacent to the three corners E1, E3, and E4 among the four corners E1 to E4. In the lower diffuser 44, the areas that are adjacent to the three corners E1, E3, and E4 may be the first areas in which the inlet 2J does not exist in the outside in radial direction of the rotation axis 41*x* as seen from the axial direction of the rotation axis 41*x*. Also, in the lower diffuser 44, the maximum inclination portion 44M may be not provided in an area (the second area) that is adjacent to the second corner E2.

However, in the upper diffuser 44, the maximum inclination portion 44M may be provided in the area that is adjacent to the third corner E3, and in the lower diffuser 44, the maximum inclination portion 44M may be provided in the area that is adjacent to the second corner E2.

Effect of the Current Embodiment

According to the outdoor unit 100 for the air conditioner of the current embodiment configured as described above, because the diffuser 44 has the maximum inclination portions 44M in areas where suction loss of the propeller fan 41 is relatively great, that is, in areas that are adjacent to the corners E1 to E4 of the front wall 2*a*, suction loss of the propeller fan 41, which is generated in the corners E1 to E4 of the housing 2 in which the inlet 2J is not located, may be reduced. Therefore, blowing performance may be improved. Also, because a flow path of the diffuser 44 towards the outlet 2H is enlarged, a distribution in flow speed towards the fan guide may become nearly constant, and pressure loss of the blower 4 may be reduced in the outdoor unit 100. Therefore, it may be possible to achieve high performance and low noise of the outdoor unit 100. Furthermore, the withdrawal of dynamic pressure by the diffuser 44 may be also expected, so that an improvement of stall strength of the propeller fan 41 may be achieved.

Also, the disclosure is not limited to the above-described embodiments.

For example, in the current embodiment, two propeller fans 41 (blowers 4) are installed vertically, however, a structure having a single propeller fan (blower) or a structure having three propeller fans (blowers) or more may be provided. In this case, the same number of outlets and diffusers as that of the propeller fan(s) may be formed in the front panel 2P.

Also, the configuration of the diffuser 44 is not limited to the above-described embodiment. For example, the maximum inclination portions 44M may be formed in areas that are adjacent to two corners (see FIG. 7A), or the maximum inclination portion 44M may be formed in an area that is adjacent to any one corner (see FIG. 7B).

Figure 7A:
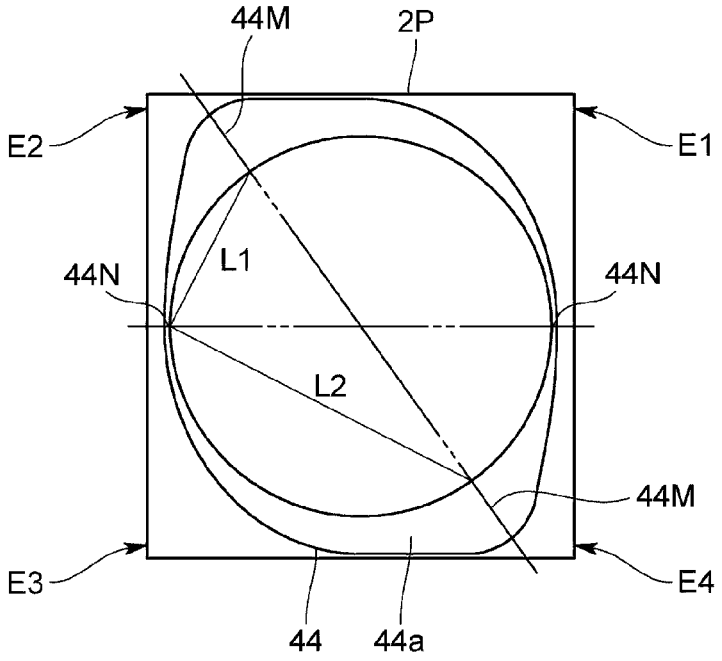
FIGS. 7A and 7B are plan views of front panels of outdoor units for an air conditioner according to modified embodiments of the disclosure.
Figure 7B:
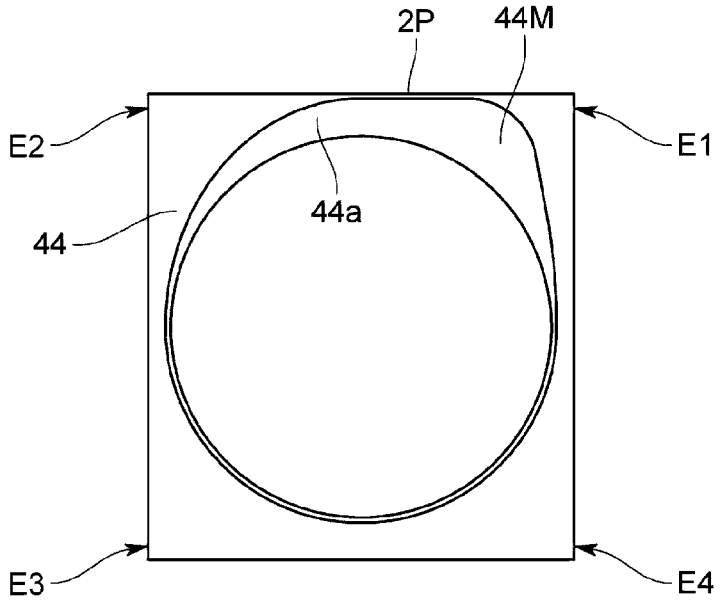
Figure 8:
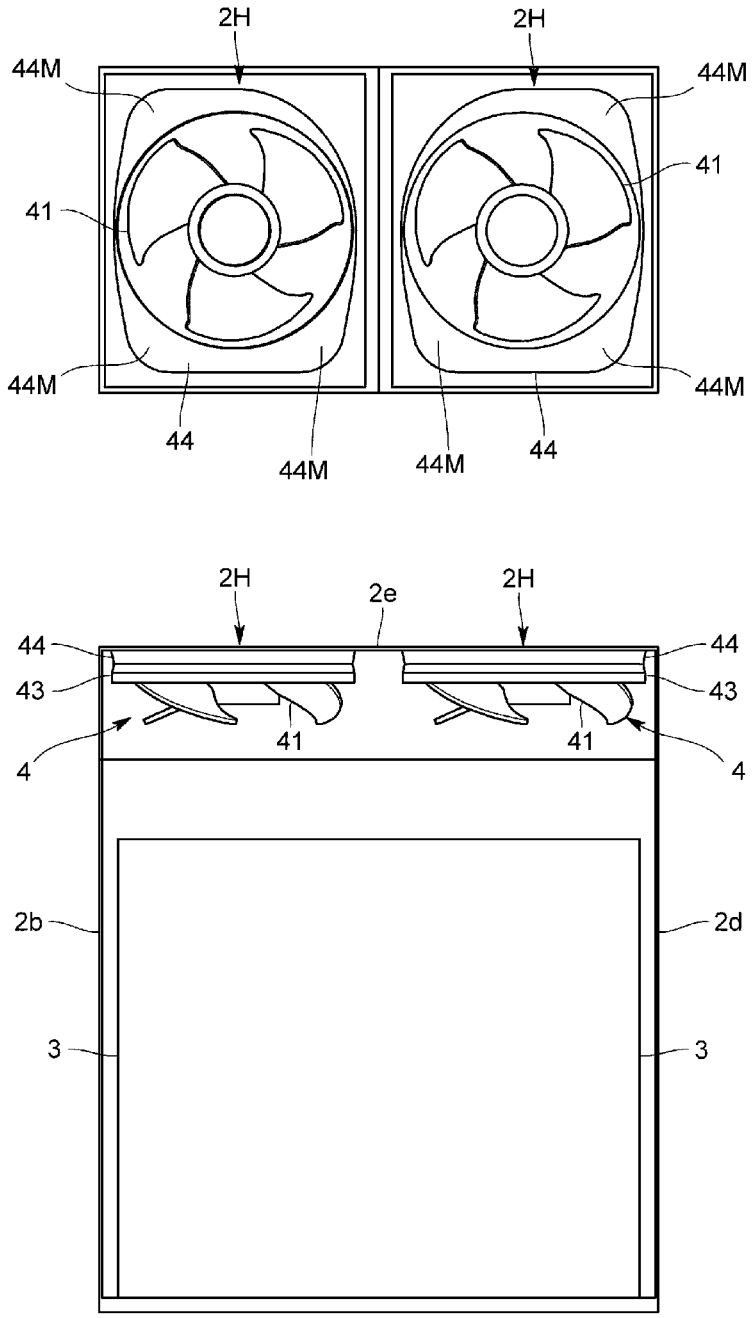
FIG. 8 is a front view and a plan view schematically showing an outdoor unit for an air conditioner according to a modified embodiment of the disclosure.

The case of FIG. 7A will be described in detail, below.

The diffuser 44 may have maximum inclination portions 44M in a first area in which the inlet 2J does not exist in the outside in radial direction of the rotation axis 41*x* as seen from the axial direction of the rotation axis 41*x*, and in a second area that is opposite to the first area. The first area may be adjacent to the second corner E1, and the second area may be adjacent to the fourth corner E4.

Also, in the diffuser 44, in a third area and a fourth area that are orthogonally opposite to the first area and the second area, no maximum inclination portion 44M may be provided. The third area may be adjacent to the first corner El, and the fourth area may be adjacent to the third corner E3.

The diffuser 44 may have minimum inclination portions 44N having a minimum inclination angle θ or a minimum opening dimension D. The minimum inclination portions 44N may be located between the maximum inclination portions 44M. A distance L1 from the maximum inclination portion 44M of the first area to the minimum inclination portion 44N may be different from a distance L2 from the maximum inclination portion 44M of the second area to the minimum inclination portion 44N of the second area.

The above-described embodiment relates to a side blowing outdoor unit, however, the above-described embodiment may be applied to a vertical blowing outdoor unit. That is, the above-described embodiment may be applied to a structure in which the outlet 2H is formed in the upper wall 2*e* of the housing 2, the propeller fan 41 faces the outlet 2H, air is inhaled through the side walls 2*b* to 2*d* of the housing 2, and air is discharged through the outlet 2H formed in the upper wall 2*e* of the housing 2.

Figure 9:
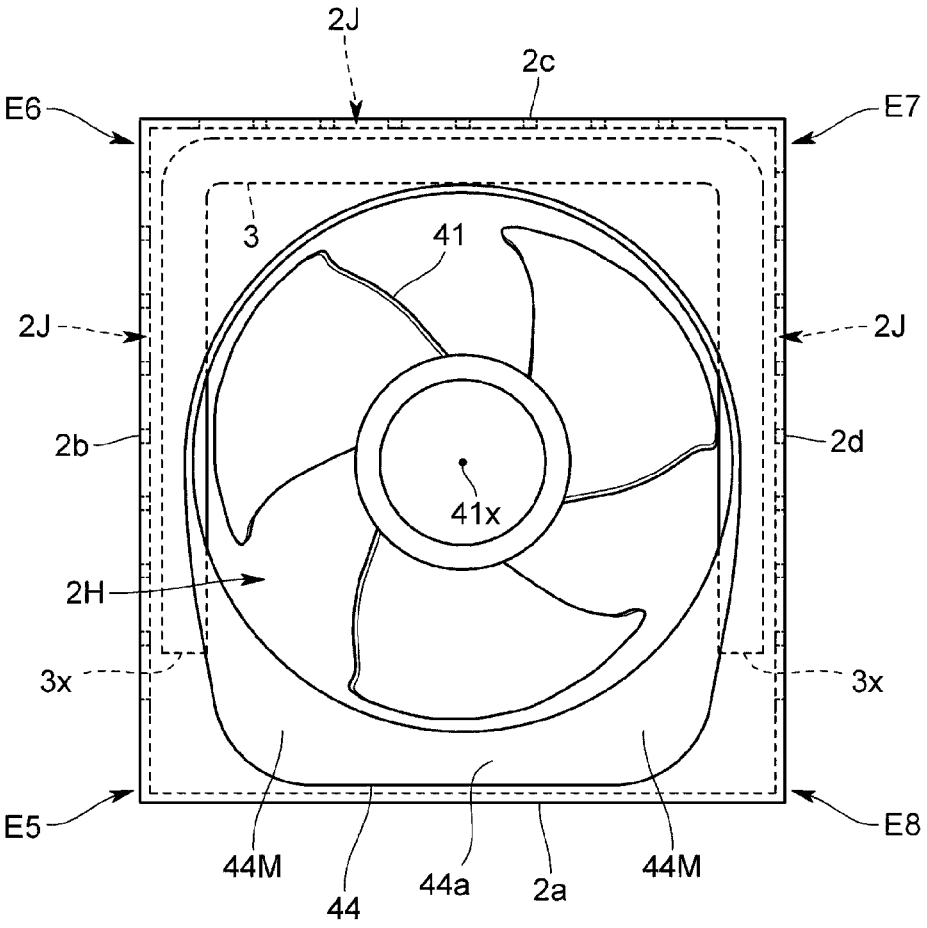
FIG. 9 is a top view schematically showing an outdoor unit for an air conditioner according to a modified embodiment of the disclosure.
Figure 10:
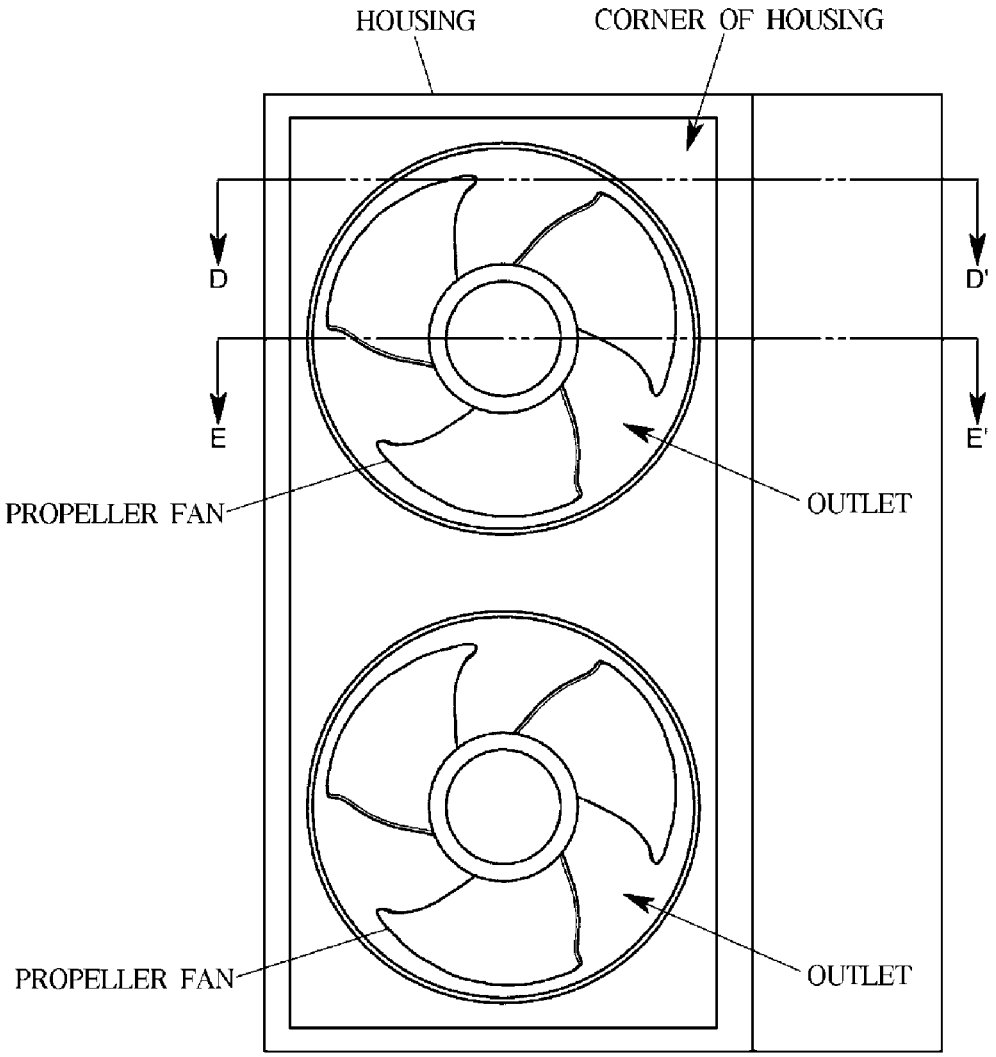
FIG. 10 is a front view of a typical outdoor unit for an air conditioner.
Figure 11:
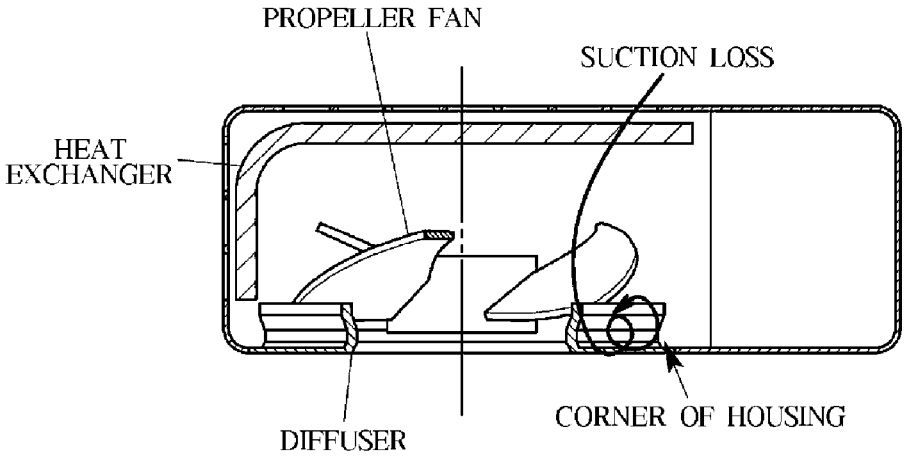
FIG. 11 is cross-sectional views taken along line D-D' and line E-E' of FIG. 10.
Figure 11:
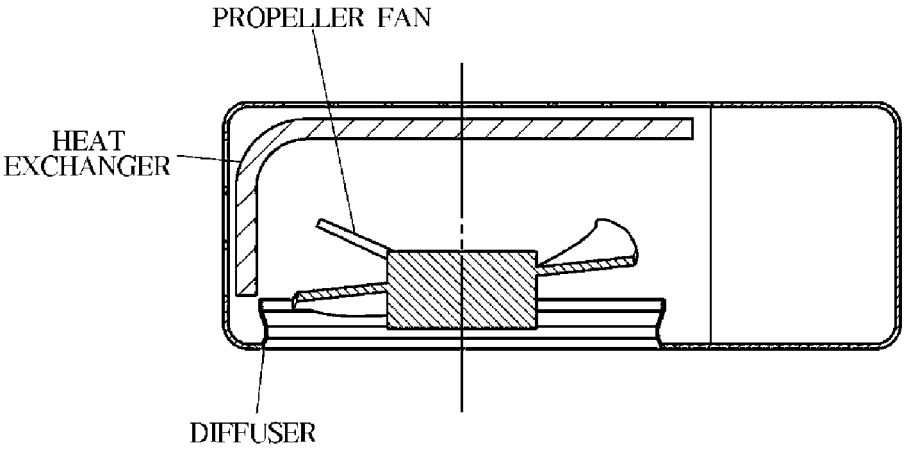

Hereinafter, a top blowing outdoor unit having a single propeller fan will be described with reference to FIG. 9. In the outdoor unit shown in FIG. 9, air inhaled through side walls 2*b* to 2*d* of a housing 2 may be discharged through an outlet 2H of a upper wall 2*e* of the housing 2. A heat exchanger 3 installed in the housing 2 of the outdoor unit may be positioned along a left wall 2*b*, a rear wall 2*c*, and a right wall 2*d* of the housing 2, and formed in a nearly inverted c shape as seen from above. One of two ends 3*x* of the heat exchanger 3 may be positioned in a front portion of the left wall 2*b*, and the other one of the two ends 3*x* of the heat exchanger 3 may be positioned in a front portion of the right wall 2*d*. The diffuser 44 may have maximum inclination portions 44M having a maximum inclination angle θ or a maximum opening dimension D, in areas that are adjacent to corners E5 and E8 in which the ends 3*x* of the heat exchanger 3 are located among four corners E5 to E8 of the upper wall 2*e*.

In the current embodiment, the diffuser 44 may have the maximum inclination portions 44M, in areas in which the inlet 2J does not exist in the outside in radial direction of the rotation axis 41*x* as seen from the axial direction of the rotation axis 41*x*. However, the maximum inclination portions 44M may be positioned in areas in which the inlet 2J is distant from the propeller fan 31 as seen from the axial direction of the rotation axis 41*x*. For example, in the current embodiment, the partition plate 21 may be omitted. A first area in which the inlet 2J is distant from the propeller fan 41 may be an area in which mechanical components, such as, for example, a compressor, etc., other than the heat exchanger 3, are positioned between the propeller fan 41 and the inlet 2J, and may be an area in which a longer flow path is formed than the area where the mechanical components are not positioned between the propeller fan 41 and the inlet 2J.

While the present disclosure has been particularly described with reference to exemplary embodiments, it should be understood by those of skilled in the art that various changes in form and details may be made without departing from the spirit and scope of the present disclosure.

The invention claimed is:

1. An outdoor unit for an air conditioner including a blowing apparatus, the blowing apparatus comprising:

a housing including an inlet, a rear wall, a left wall, a right wall, and a front wall in which an outlet is formed and the left wall and the right wall being located in both sides of the rear wall;

a propeller fan positioned inside of the housing, the propeller fan facing the outlet; and a diffuser positioned at a discharging side of the propeller fan, and forming the outlet, wherein the diffuser comprises an inclined surface inclined with respect to a rotation axis of the propeller fan, and an inclination angle of the inclined surface to the rotation axis of the propeller fan changes according to a circumferential direction of the diffuser, wherein the inclination angle of the inclined surface is a maximum angle in an area in which the inlet does not exist and a minimum angle in an area adjacent to the inlet, wherein the front wall is a polygon shape with a plurality of corners, and a maximum value of the maximum inclination angle appears in an area that is adjacent to at least one corner among the plurality of corners of the front wall, and wherein the maximum inclination angle is positioned to correspond to a corner that is most adjacent to at least one of the left wall and the right wall.

2. The outdoor unit according to claim 1, wherein the front wall is a front surface of the housing.

3. The outdoor unit according to claim 2, wherein the inlet is formed in at least one of the rear wall, the left wall, and the right wall.

4. The outdoor unit according to claim 2, wherein the housing comprises a front panel forming the front wall, and the diffuser is integrated into the front panel.

5. The outdoor unit according to claim 1, wherein the maximum inclination portion is formed in one end of the inclined surface.

6. The outdoor unit according to claim 1, wherein at least two maximum inclination portions are positioned to correspond to neighboring corners among the plurality of corners.

7. The outdoor unit according to claim 1, wherein at least two maximum inclination portions are positioned to correspond to corners among the plurality of corners that are furthest away from the inlet.

8. The outdoor unit according to claim 3, further comprising a heat exchanger formed along the inlet to correspond to the inlet.

9. An outdoor unit for an air conditioner including a blowing apparatus, the blowing apparatus comprising:

a housing in which an inlet and an outlet are formed;

a propeller fan positioned in the inside of the housing, and configured to discharge air inhaled through the inlet through the outlet; and a diffuser positioned at a discharging side of the propeller fan, and including an opening, wherein a radius of an end of the opening of the diffuser in a radial direction of the propeller fan changes according to a circumferential direction of the diffuser, and wherein the radius is a maximum value in only three corners of the diffuser corresponding to walls of the housing and a minimum value in an area adjacent to the inlet.

10. The outdoor unit according to claim 9, wherein the end of the opening of the diffuser comprises a maximum inclination portion in which the radius of the end of the opening of the diffuser is the maximum value.

11. The outdoor unit according to claim 10, wherein the maximum inclination portion is positioned in a first area corresponding to an area in which the inlet does not exist in the housing.

12. The outdoor unit according to claim 11, wherein the maximum inclination portion is positioned in a second area that is opposite to the first area.

13. The outdoor unit according to claim 12, wherein the end of the opening of the diffuser comprises a minimum inclination portion with a minimum radius, and a distance from the maximum inclination portion of the first area to the minimum inclination portion is different from a distance from the maximum inclination portion of the second area to the minimum inclination portion.

14. The outdoor unit according to claim 10, wherein the housing comprises a front wall in which the outlet is formed, the front wall is a polygon shape with a plurality of corners, and at least three maximum inclination portions are positioned to correspond to neighboring corners among the plurality of corners.

15. The outdoor unit according to claim 10, wherein the housing comprises a front wall in which he outlet is formed, the front wall is a polygon shape with a plurality of corners, and at least two maximum inclination portions are positioned to correspond to corners among the plurality of corners that are furthest away from the inlet.

16. The outdoor unit according to claim 10, wherein the housing comprises a front wall in which the outlet is formed, and a left wall and right wall located in both sides of the front wall, and the maximum inclination portion is positioned to correspond to a corner that is most adjacent to at least one of the left wall and the right wall.

* * * * *